US005791649A

United States Patent [19]

DiSandro

[11] Patent Number: 5,791,649

[45] Date of Patent: Aug. 11, 1998

[54] POKER STYLE BOARD GAME AND METHOD FOR PLAYING SAME

[76] Inventor: Nicholas Mark DiSandro, Six Birch Rd., Greenville, R.I. 03838

[21] Appl. No.: 901,255

[22] Filed: Jul. 28, 1997

[51] Int. Cl.[6] ..... A63F 3/00

[52] U.S. Cl. ..... 273/243; 273/274; 273/146

[58] Field of Search ..... 273/243, 268, 273/274, 248, 146

[56] References Cited

U.S. PATENT DOCUMENTS

| | | | |
|---|---|---|---|
| 244,520 | 7/1881 | Bacon . | |
| 614,524 | 11/1898 | Yardley . | |
| 1,481,628 | 1/1924 | Souza . | |
| 2,148,102 | 2/1939 | Brumer . | |
| 3,033,572 | 5/1962 | Thibault . | |
| 3,427,027 | 2/1969 | Kenyon . | |
| 4,334,685 | 6/1982 | Robbins et al. . | |
| 4,643,431 | 2/1987 | Hilinsky | 273/243 |
| 4,746,126 | 5/1988 | Angileri . | |
| 4,936,588 | 6/1990 | Rader et al. . | |
| 5,046,736 | 9/1991 | Bridgeman et al. | 273/243 |
| 5,125,660 | 6/1992 | Stahl | 273/146 |
| 5,169,148 | 12/1992 | Whealer | 273/146 |
| 5,265,881 | 11/1993 | Doherty . | |
| 5,308,081 | 5/1994 | Bartle . | |
| 5,413,351 | 5/1995 | Franklin . | |
| 5,683,088 | 11/1997 | Rose | 273/243 |

*Primary Examiner*—William M. Pierce
*Attorney, Agent, or Firm*—Salter & Michaelson

[57] ABSTRACT

A board game apparatus includes a game board having a plurality of sequentially arranged game squares which follow a path of progression along the game. The game squares list a plurality of traditional poker hands thereon. A six-sided numeric die is provided for determining advancement of token playing pieces along the path of progression on the game board. Nine six-sided dice each side having one of fifty-two different playing card indicia listed thereon as well as two sides listing a joker or other wild card indicia are provided for attempted attainment of the poker hand listed on the game square that a token playing piece sets.

8 Claims, 4 Drawing Sheets

SCORING SHEET

NAME:_____

| | 204 | 205 | 206 | 207 |
|---|---|---|---|---|
| 176 | PAIRS OR BETTER 10 POINTS | GAME #1 | GAME #2 | GAME #3 |
| 177 | DEUCES | | | |
| 178 | THREES | | | |
| 179 | FOURS | | | |
| 180 | FIVES | | | |
| 181 | SIXES | | | |
| 182 | SEVENS | | | |
| 183 | EIGHTS | | | |
| 184 | NINES | | | |
| 185 | TENS | | | |
| 186 | JACKS | | | |
| 187 | QUEENS | | | |
| 188 | KINGS | | | |
| 189 | ACES | | | |
| 190 | MULTI-PAIRS 10 POINTS PER PAIR | | | |
| 191 | 3 OF A KIND 20 POINTS | | | |
| 192 | STRAIGHT SEQUENCE OF 5 30 POINTS | | | |
| 193 | FLUSH SEQUENCE OF 5 35 POINTS | | | |
| 194 | FULL HOUSE 40 POINTS | | | |
| 195 | 4 OF A KIND 45 POINTS | | | |
| 196 | STRAIGHT FLUSH 50 POINTS | | | |
| 197 | ROYAL STRAIGHT FLUSH 60 POINTS | | | |
| 198 | 5 OF A KIND 75 POINTS | | | |
| 199 | TOTAL | | | |
| 200 | BIG BONUS 6 OF A KIND 100 POINTS | | | |
| 201 | PENALTY BOX MINIMUM FACE VALUE OF ALL DICE | | | |
| 202 | GRAND TOTAL | | | |

174

208

20

FIG. 5

POKER STYLE BOARD GAME AND METHOD FOR PLAYING SAME

BACKGROUND AND SUMMARY OF THE INVENTION

This invention relates generally to amusement devices and more particularly to a board game apparatus having a poker related game theme. Generally, the game includes a plurality of dice with playing card indicia thereon which are utilized to obtain predetermined poker hands listed on various game squares located on the game board.

There have heretofore been known in the prior art a variety of board games which utilize dice having playing card indicia thereon. In this regard, U.S. Pat. No. 614,524, issued to Yardley, and U.S. Pat. No. 3,033,572, issued to Thibault, represent the closest prior art to the subject matter of the instant invention of which the applicant is aware. Each of these patents generally discloses a game including dice with playing card indicia listed thereon; however, neither of these patents shows a board game having an arrangement or a method of play similar to that of the instant invention.

The instant invention is directed to a board game apparatus and method for playing the same having a poker related game theme. The board game includes: a game board having a plurality of sequentially arranged game squares, each square listing either a predetermined poker hand, a plain black square, or a green directional arrow; nine six-sided dice, totaling fifty-four sides, wherein each side of the dice lists one of the fifty-two different playing card indicia as well as two sides having a joker or other wild card indicia; four playing tokens, each token shaped to designate one of the four playing card suits, i.e., clubs, spades, hearts, or diamonds; one traditional six-sided numeric die, each side listing a number ranging from one through six; and a selectively arranged scoring sheet for keeping each players game score.

A general method of playing the instant game includes first selecting the number of players, ranging from two through four, and throwing the six-sided numeric die to determine, by the highest number, a playing order. The player with the highest number die starts the game by rolling the six sided numeric die again and advancing his selected character token that number of spaces along the path of progression on the game board. If the player lands on a game square that lists a predetermined poker hand, he must try to obtain that hand by rolling the nine card-faced dice. He then selects from his roll the dice needed to roll again to reach his goal. He may roll his dice to a total of three times to successfully obtain his goal. After his third roll, the turn is completed, he marks his score-sheet and the next player to the left takes his turn. If a token lands on a green arrow space, the player slides his token to the next space. If the token lands on a black square, the player loses his turn and play continues to the next person to the left. Game play continues until one player's score sheet is filled. The player with the highest score wins. Other versions of poker card games and solitaire games can also be played using the game apparatus.

The instant board game is designed to enable a player of any skill level to participate in game play and incorporates a significant element of chance to capture and maintain the interest of a wide range of potential players for the entire length of the game.

Accordingly, it is seen that the instant invention provides an effective game apparatus that can be utilized by game players for playing a highly amusing game. Specifically, the game apparatus is operative for playing an amusing game wherein poker skills have significant impact on the abilities of players to achieve the games objective. As a result, the board game apparatus and method of play are operable for playing a game which has an interesting and novel theme which can easily capture the attention of game players for extended periods of time.

Therefore, it is a primary object of the instant invention to provide an interesting and unusual poker related board game that is effective for play by any skill level player.

Another object of the instant invention is to provide a method for playing a game wherein game players of any skill level may participate in the same game.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention:

FIG. 5 is a top view of the scoring sheet of the instant invention.

Corresponding reference numbers designate corresponding parts throughout the drawings.

DETAILED DESCRIPTION OF THE PREFERRED EMBODIMENT

Figure 1:
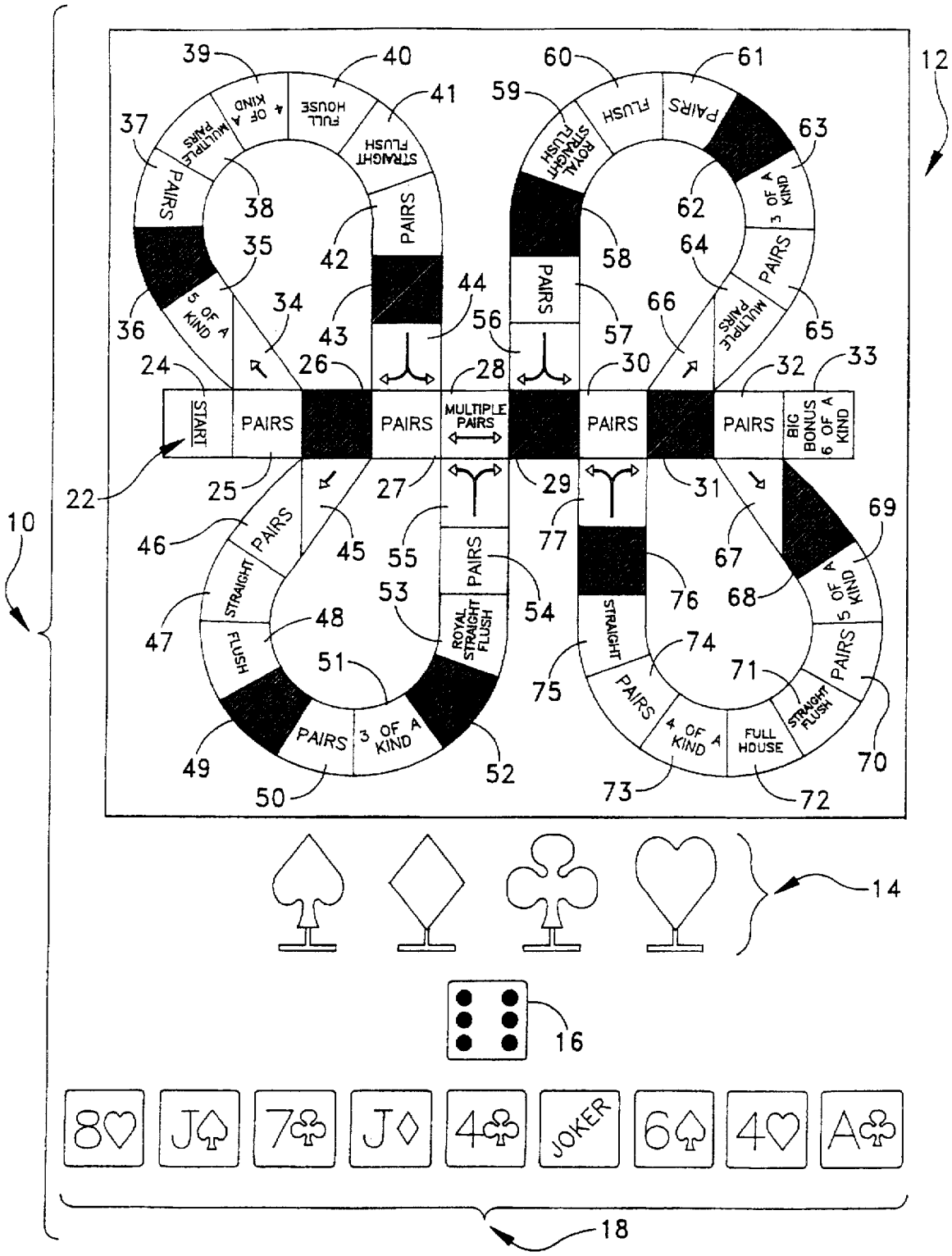
FIG. 1 is a top plan view showing the game board of the instant invention; the token playing pieces; the six-sided numeric die; and nine six-sided card-faced dice.

Referring now to the drawings, and more particularly to FIG. 1, the game board apparatus of the instant invention is illustrated and generally indicated at 10. As will hereinafter be more fully described, the instant game board apparatus and method for playing same provides a highly amusing poker related game theme having unlimited play value which can be enjoyed by many skill level poker players alike.

The board game apparatus 10 which is operative in connection with the method of the instant invention is illustrated in FIGS. 1–5, and comprises a game board generally indicated at 12 in FIG. 1, four game playing pieces generally indicated at 14 in FIG. 1, a six-sided numeric die indicated at 16 in FIG. 1, nine six-sided dice listing playing card indicia thereon indicated at 18 in FIG. 1, and a selectively arranged scoring sheet generally indicated at 20 in FIG. 5.

Referring first to FIG. 1, the game board 12 has a plurality of game squares which set forth a path of advancement generally indicated at 22 thereon which is defined by a plurality of sequential locations 24 through 77. The location 24 is designated as the starting location on the path 22. The majority of the remaining locations, or approximately 60% of the game squares, are designated as various traditional poker hands as illustrated in FIG. 1 on the game board.

Locations 26, 29, 31, 36, 43, 49, 52, 58, 62, 68, and 76 are designated as plain black squares, and locations 34, 44, 45, 55, 56, 66, 67, and 77 are designated as green directional arrows. The game board 12 is preferably fabricated from a cardboard material having a generally square shape with a crease formed through the center of the board 12 for folding the game board in half for easier storage of the game board when the game apparatus 10 is not in use. Each game square location upon the game board 12 may be printed thereon having a variety of different aesthetically pleasing colors providing for a finished game board playing surface.

Figure 2:
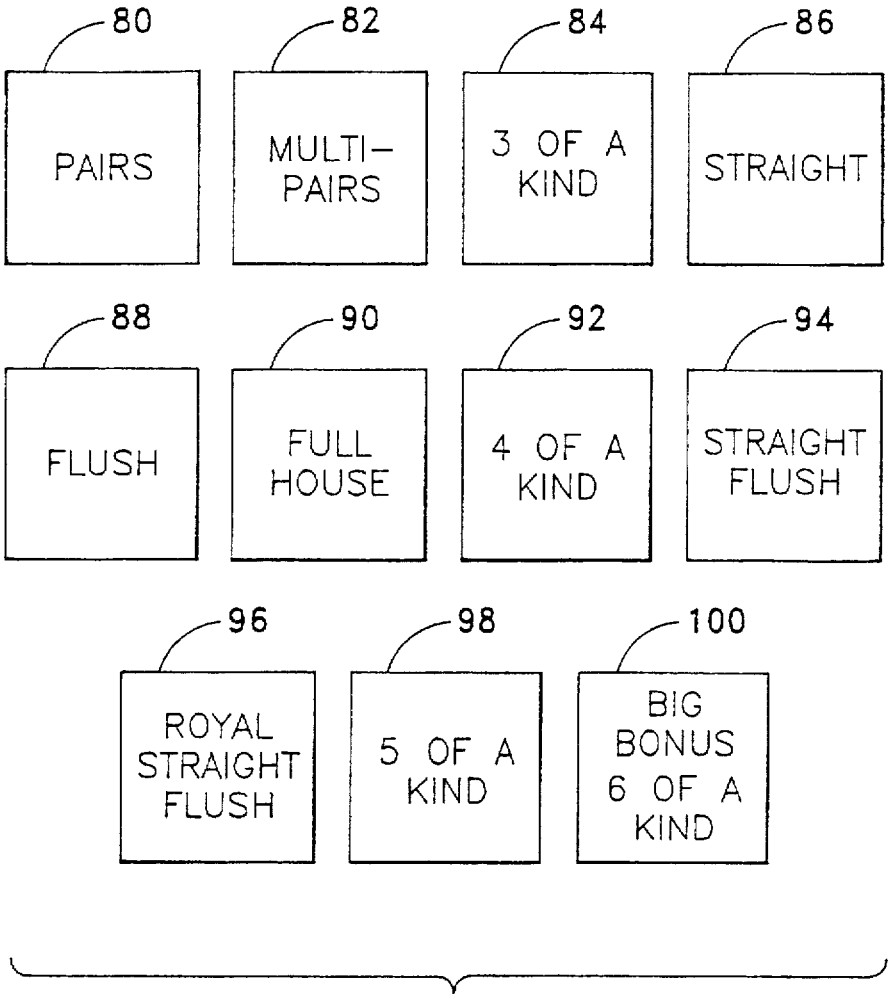
FIG. 2 is an enlarged top plan view showing each of the different game squares listed on the game board.

FIG. 2 illustrates the different poker hands listed on the game board game squares. Pairs are indicated at 80; multiple pairs are indicated at 82; three of a kind is indicated at 84; straight is indicated at 86; flush is indicated at 88, full house is indicated at 90, four of a kind is indicated at 92, straight flush is indicated at 94, royal straight flush is indicated at 96, five of a kind is indicated at 98 and the "big bonus" six of a kind is indicated at 100. Following traditional poker rules, pairs 80 represents any two cards having the same number, including face cards and aces. Multiple pairs 82 represents sets of pairs, ie. since there are nine dice up to four sets of pairs are possible. Three of a kind 84 represents any three cards having the same number, including face cards and aces. Straight 86 represents five cards in order by number. Flush 88 represents any five cards of the same suit. Full house 90 represents any three cards having the same number and any two cards having the same number, in other words, a three of a kind and a two of a kind. Four of a kind 92 represents any four cards having the same number including face cards and aces. Straight flush 94 represents five cards in order by number and of the same suit. Royal straight flush 96 represents the same sequence as a straight flush except it must be the ace through ten of the same suit. Five of a kind 98 represents any five cards having the same number, which is possible due to the existence of at least one wild card, including face cards and aces. Six of a kind "the big bonus" 100 represents any six cards having the same number, which is possible due to the existence of at least two wild cards, including face cards and aces.

Figure 3:
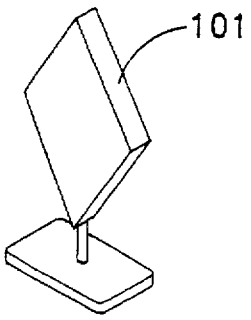
FIG. 3 is a perspective view showing the diamond token playing piece.

A plurality of playing pieces, such as the playing pieces 14, are preferably provided, each playing piece preferably being of a different configuration, or of a different color, in order to enable game players to distinguish their playing pieces from those of other players. The playing pieces are preferably formed in sizes which enable them to be positioned on various locations in the path on the game board. Specifically, the playing pieces are shaped to mimic the different playing card suits in a deck of cards, i.e. spades, clubs, hearts and diamonds and are colored red or black corresponding to the traditional suit color. FIG. 3 illustrates a playing piece icon 101 that represents the diamond playing card suit.

The die 16 illustrated in FIG. 1 is of conventional construction and is operative for randomly determining the number of locations which the playing pieces of game players are advanced during their turns, it being understood that the use of various other random devices, such as an electronic random number generator, is also contemplated.

Figure 4:
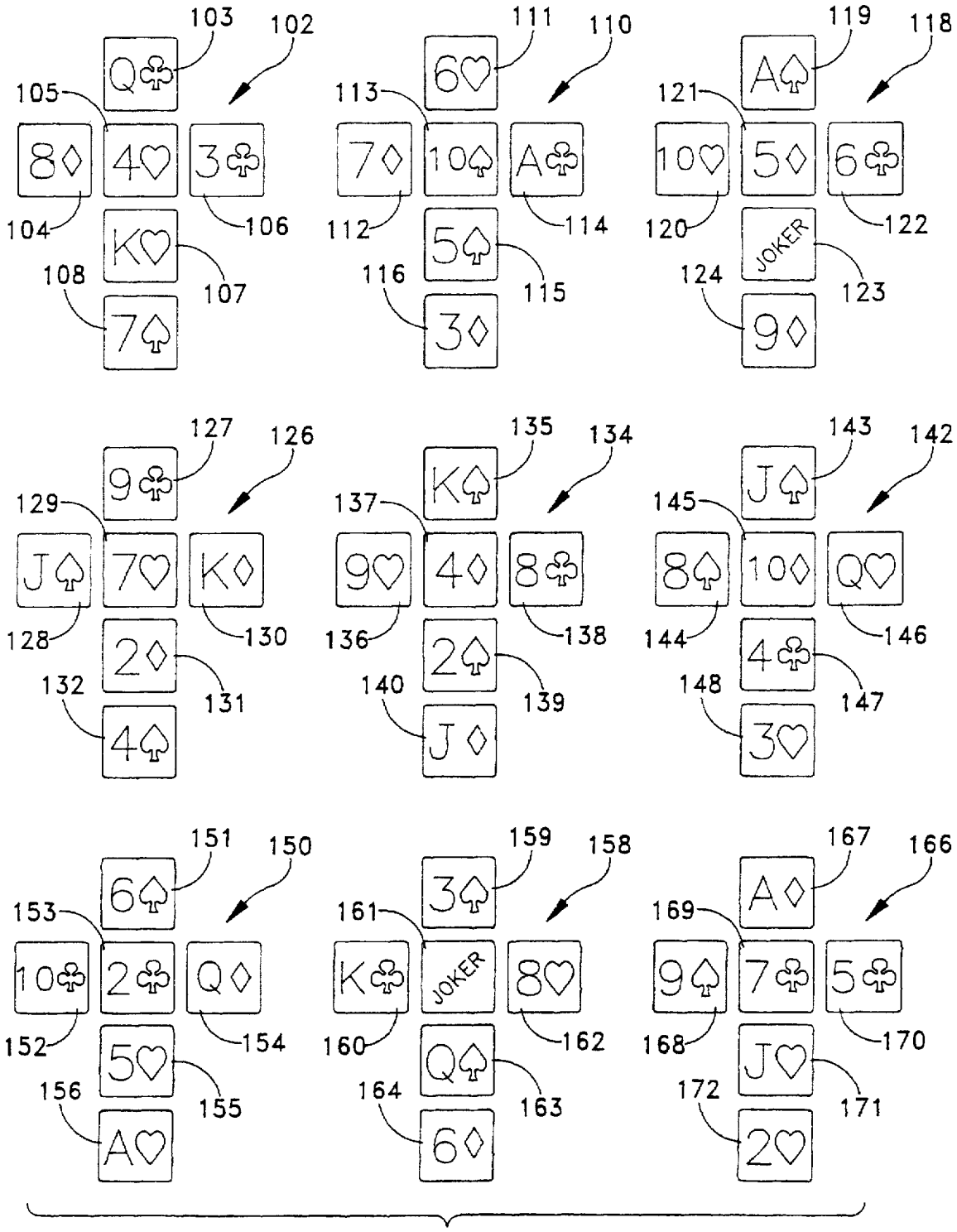
FIG. 4 is a plan view showing the specific arrangement of the card-faced indicia listed on each side of the nine dice.

The dice 18 illustrated in FIG. 1 are also of conventional construction but list playing card indicia thereon instead of numbers. Referring to FIG. 4, nine different six-sided dice are provided, totaling fifty-four sides, wherein each side of each die lists a different one of the fifty-two different playing card indicia. The remaining two sides have a joker or other wild card indicia. It should be understood that four sets of the nine dice may be provided allowing one set for each of the four participating players. FIG. 4, depicts the nine six-sided dice and the ordered arrangement of playing card indicia listed thereon. Specifically, the nine six-sided dice 18 are arranged as follows: die 102 lists queen of spades 103, eight of diamonds 104, four of hearts 105, three of clubs 106, king of hearts 107 and seven of spades 108; die 110 lists six of hearts 111, seven of diamonds 112, ten of spades 113, ace of clubs 114, five of spades 115 and three of diamonds 116; die 118 lists ace of spades 119, ten of spades 120, five of diamonds 121, six of clubs 122, joker 123, and nine of diamonds 124; die 126 lists nine of clubs 127, jack of spades 128, seven of hearts 129, king of diamonds 130, two of diamonds 131 and four of spades 132; die 134 lists king of spades 135, nine of hearts 136, four of diamonds 137, eight of clubs 138, two of spades 139 and jack o diamonds 140; die 142 lists jack of spades 143, eight of spades 144, ten of diamonds 145, queen of hearts 146, four of clubs 147 and three of hearts 148; die 150 lists six of spades 151, ten of clubs 152, two of clubs 153, queen of diamonds 154, five of hearts 155 and ace of hearts 156; die 158 lists three of spades 159, king of clubs 160, joker 161, eight of hearts 162, queen of spades 163 and six of diamonds 164; and die 166 lists ace of diamonds 167, nine of spades 168, seven of clubs 169, five of clubs 170, jack of hearts 171 and two of hearts 172. The arrangement of the card indicia on the nine dice 18 is critical to proper play of the game since the different poker hands must be obtained using a single set of nine dice. For instance, it is pointed out that no two playing card indicia of the same value, i.e. ace, two, three, four, etc. are shown on the same die. In this regard, poker hands of up to at least four of a kind may be obtained. Likewise it is pointed out that no two consecutive playing card indicia of a like suit are shown on a single die. In this regard, it is possible to obtain straight flush poker hands using the dice.

The scoring sheet 20 illustrated in FIG. 5 is fabricated from any suitable paper material and lists the different scoring combinations thereon. Preferably, the sheet contains a margin 174, twenty-seven rows designated 176 through 202, and four columns designated 204 through 207 which define a plurality of blank cells each indicated at 208 to be filled in with the predetermined point values associated with the poker hands listed in the first column 204 of the scoring sheet 20. The margin 174 lists a fill in the blank for the name of the game player using the score sheet 20. It being understood that each game player has his own scoring sheet. The first cell 208 of the first row 176 of the scoring sheet 20 lists pairs or better and the corresponding point value of ten associated with a pair of deuces through a pair of aces. The remaining cells 208 of the first row 176 list the game number starting at one and ending at three. It being understood that one score sheet 20 can be used for multiple games, and also that the maximum number of games per sheet does not necessarily have to be three. The arrangement is such that a single column is designated for each game that is to be played. The first cell 208 of rows 177 through 189 lists pairs ranging from deuces through aces. The first cell 208 of rows 190 through 198 lists: multiple pairs and the point value of ten per each pair; three of a kind and the point value of twenty; straight sequence of five and the point value of thirty; flush sequence of five and the point value of thirty-five; full house and the point value of forty; four of a kind and the point value of forty-five; straight flush and the point value of fifty; royal straight flush and the point value of sixty; and five of a kind, because there are two jokers in the dice which are wild, and the point value of seventy-five. The first cell 208 of row 199 lists the total row for adding rows 177 through 198. The first cell 208 of row 200 lists the "big bonus" six of a kind and the point value of one hundred. The first cell 208 of row 201 lists the penalty box which designates the number for the minimum face value of all dice, and the first cell 208 of row 202 lists the grand total for adding rows 177 through 201 for determining the players final score and outcome.

For use and operation of the game apparatus 10 in accordance with the method of the instant invention, each game player is initially given a game piece 14. A sequential playing order for the game players is then determined by rolling the numeric die 16 and determining, by the highest number, a playing order. Thereafter the game players sequentially roll the die 16 and move their game pieces 14 along the path. When a game player lands on one of the game squares listing a poker hand, such as a three of a kind 84, flush 88, etc., he or she must try to obtain that hand by rolling the nine six-sided dice 18. It being understood that if there are four players, each player takes turns using the nine six-sided dice. As mentioned above, four sets of the nine dice may be provided so that each player has his own set of dice. The player then selects from his roll the dice 18 needed to roll again to reach his goal. The player may roll his dice 18 up to a total of three times. After the third roll is done, the turn is completed, the player marks the score sheet 20 with the score obtained on that turn, and the next player, on the left, must take his turn. If a player token 14 lands on a green directional arrow space, the player slides his icon to the next game square. If the player token 14 lands on a black square, the player loses his turn and play goes to the next person on the left. The game is over when a player obtains all of the poker hands listed in column 204 of the score sheet 20. The length of an average game should take between one to one and a half hours. At the completion of the game, each player totals his or hers scores and the player with the highest score wins.

As mentioned above, a penalty box is listed on the score sheet 20 and is utilized, only once, when a player lands on a game square listing a poker hand that has already been accomplished. Since the player is unable to write over a previous score with a new score, he must roll the nine six-sided dice 18 and count the face value of each of the nine dice and put that as a minus in the penalty box, during scoring that score will be subtracted into the grand total. If a player lands on a game square listing a poker hand that has already been accomplished, after the penalty box has been filled, the player must then begin to cross out point values that have not yet been accomplished and then proceed to cross out point values that have already been accomplished, preferably something of a low point value listed at the top of the score sheet.

The method of play described above is the preferred embodiment of the instant invention and is known as "High Stakes". However, variations of the preferred embodiment may also be utilized. High Stakes "quick version" has a method of play identical to the High Stakes version except the game board and the numeric six-sided die are kept out of the game. Specifically, each player in clockwise succession rolls the nine dice up to a total of three times per turn in order to obtain the highest possible score listed on the score sheet. As in the preferred embodiment, when the score sheet column is filled, the game is over and the person with the highest hand point total wins.

A Pitch Poker game version is played with the nine six-sided dice, an equal number of chips for each player, and the six-sided numeric die. Each player antes a chip into the "pot" and the starter then rolls his nine six-sided dice up to a total of three times to attain the highest poker hand of five dice. The remaining players, in turn, attempt to beat the starter's hand by rolling the nine dice up to three times for a better poker hand. After everyone's turn is complete, the person with the highest poker hand collects the chips from the "pot" and the play starts over with the next person in clock-wise order from the starter. The game is over after one of the player's loses all of his chips, or the game may be played with a predetermined number of rounds.

Another version, entitled Dice-No-Peek, is played with the same equipment as the Pitch Poker version, namely, the nine card dice, an equal number of chips for each player, and the numeric six-sided die. The first player randomly chooses and rolls one of the nine six-sided dice. He then chooses to bid a chip or pass, if a chip is bid then the remaining players who wish to stay in the round must also put a chip in the pot. The play continues in a clock-wise direction and the next player randomly chooses and rolls one of the nine card dice. If the value of the die is higher, he may choose to bid a chip or pass, if the value of the die is not higher, that player must randomly choose and roll another die, one by one, until a higher hand is obtained from the previous player. If a higher hand is obtained that player may then choose to bid or pass and play continues in a clock-wise direction. The round is complete when everyone has played all of the nine dice. The player obtaining the highest poker hand wins the "pot" for that particular round and play resumes in a clock-wise direction. The game is over after one player loses all their chips or after a predetermined number of rounds. The chips are then counted and the player with the most chips wins.

It can therefore be seen that the instant invention provides a plurality of effective methods of playing a board game. The board game apparatus is adapted to be utilized in a game which allows game players to utilize their poker skills. Further, the game apparatus is adapted to be utilized by game players with any skill level. Hence, it is seen that the instant invention provides a board game apparatus which is adapted to be used in connection with novel and interesting methods of play which have a high degree of amusement value and which can effectively capture the attention of game layers for extended periods of time. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A board game apparatus comprising:

a game board having a plurality of sequentially arranged game squares which follow a path of progression along said game board, said game squares listing predetermined playing card hands from the game of poker thereon wherein each square has indicia thereon that represents a single playing card hand made up of a plurality of playing card indicia wherein each of said playing card hands comprise pairs, multiple pairs, three of a kind, straight sequence of five, full house, four of a kind, straight flush, royal straight flush, five of a kind and six of a kind;

a plurality of six-sided dice each side thereof having one of fifty-two different playing card indicia;

a plurality of game tokens for use in marking movement of the players along the game squares; and means for randomly determining a number of game squares for each player to move on an allotted turn.

2. A board game apparatus as set forth in claim 1, wherein there are nine six-sided dice each side of said dice having one of the fifty-two different playing card indicia listed thereon, and further having two sides including wild card indicia listed thereon.

3. A board game apparatus as set forth in claim 1, wherein said plurality of game tokens comprises four game token pieces each identifying a separate playing card suit.

4. A board game apparatus as set forth in claim 3, wherein said playing card suits comprise spades, clubs, diamonds and hearts.

5. A board game apparatus as set forth in claim 1, wherein said means for randomly determining the number of game squares for advancement on an allotted turn comprises a six-sided numeric die.

6. A board game apparatus as set forth in claim 1, further including a selectively arranged scoring sheet for keeping game score.

7. A method of game play using board game apparatus including a game board having a plurality of sequentially arranged game squares sequentially arranged in a path wherein selected ones of said game squares have a playing card hand shown thereon, said board game apparatus further including a set of multi-sided dice having different playing card indicia on each respective side thereof, said method of game play comprising the steps of:

a. advancing a player token a predetermined number of spaces along the game path to a predetermined game square;

b. determining the playing card hand listed on the game square; and c. rolling the set of dice a predetermined number of times in an attempt to match selected sides of the dice with the playing card hand on the game square.

8. The method of claim 7, wherein said nine six-sided dice may be rolled up to a maximum of three times in order to obtain the indicated playing hand listed on the game board game square which the player token lies.

* * * * *